US005102474A

United States Patent [19]

Eck et al.

[11] Patent Number: 5,102,474

[45] Date of Patent: Apr. 7, 1992

[54] PROCESS FOR MANUFACTURING SEMI-FINISHED PRODUCTS FROM SINTERED REFRACTORY METAL ALLOYS

[75] Inventors: Ralf Eck; Gerhard Leichtfried, both of Reutte, Austria

[73] Assignee: Schwarzkopf Technologies Corporation, New York, N.Y.

[21] Appl. No.: 397,456

[22] Filed: Sep. 1, 1990

[30] Foreign Application Priority Data

Nov. 9, 1987 [AT] Austria ..... 2949/87

[51] Int. Cl.[5] ..... C22F 1/00

[52] U.S. Cl. ..... 148/11.5 P; 148/11.5 F; 148/130; 148/133; 148/423

[58] Field of Search ..... 148/11.5 P, 11.5 F, 148/130, 133, 423

[56] References Cited

U.S. PATENT DOCUMENTS

| | | | |
|---|---|---|---|
| 2,628,926 | 2/1953 | Ramage et al. | 148/11.5 F |
| 2,692,216 | 10/1954 | Baker | 148/11.5 F |
| 3,297,496 | 1/1967 | Chang et al. | 148/11.5 F |
| 3,377,211 | 4/1968 | Schoenfeld | 148/423 |
| 3,676,083 | 7/1972 | Cheney et al. | 420/429 |
| 4,647,317 | 3/1987 | Rosecrans | 148/11.5 F |

FOREIGN PATENT DOCUMENTS

| | | |
|---|---|---|
| 386612 | 9/1988 | Austria . |
| 0119438 | 9/1984 | European Pat. Off. . |
| 1064056 | 4/1967 | United Kingdom . |
| 1129462 | 10/1968 | United Kingdom . |
| 1298944 | 12/1972 | United Kingdom . |

*Primary Examiner*—R. Dean
*Assistant Examiner*—Robert R. Koehler
*Attorney, Agent, or Firm*—Morgan & Finnegan

[57] ABSTRACT

In a process for manufacturing semi-finished products from sintered refractory metal alloys with a stacked microstructure, the sinter feed reshaped by at least 85% is subjected prior to recrystallization annealing to an intermediate annealing for at least 20 minutes at a temperature not less than 700° C. and not greater than that at which no further recrystallization occurs. Following this intermediate annealing, the hot feed is deformed by a further 3% to 30%. The process makes it possible to manufacture semi-finished products with a good stacked microstructure and of substantially greater dimensions, or of the same dimensions and a substantially better stacked microstructure, than can be obtained with known manufacturing processes.

6 Claims, No Drawings

PROCESS FOR MANUFACTURING SEMI-FINISHED PRODUCTS FROM SINTERED REFRACTORY METAL ALLOYS

The invention covers a process for manufacturing semi-finished products from sintered refractory metal alloys having a stacked microstructure, in which the sintered product is reshaped by at least 85% by mechanical deformation in several reshaping steps and is then subjected to a recrystallization annealing treatment.

In order to improve the hot strength and creeping strength of refractory metals at high temperatures, various methods of alloying refractory metals have so far been developed.

According to a known process limited to powder metallurgy, a refractory base metal is treated with certain elements and is subjected to intensive mechanical reshaping during manufacture, achieving a reshaping factor of at least 85%. In this manner, the refractory metal alloy assumes a very specific type of microstructure, the so-called stacked microstructure, which is characterized by elongated granules with a length/-width ratio of at least 2 to 1.

Examples of known refractory metal alloys of this type are tungsten and molybdenum alloys treated with small amounts of aluminum, silicon and potassium, or with silicon and potassium.

To manufacture these alloys, the sintered base material is heated to a temperature of between about 1350° C. and about 1450° C. and is then reshaped by mechanical deformation, such as by rolling or round-forging and drawing, in several stages up to a final reshaping factor of 85%. The reshaping factor is a measure for the degree of plastic deformation that has been achieved and can be calculated by the formula $$\frac{A_a - A_e}{A_a} \times 100$$

where $A_a$ stands for the cross-sectional area of the sintered base material and $A_e$ stands for the cross-sectional area of the finished product. To facilitate reshaping and to avoid cracks in the material, it is important to maintain the required reshaping temperature during the entire reshaping process, so that reheating is usually necessary between the various reshaping stages. Following completion of the reshaping process, the material is subjected to a recrystallization annealing treatment. The recrystallization temperature depends on the type of alloy and on the degree of reshaping that has been applied. The higher the degree of reshaping, the higher will be the temperature required for recrystallization with this type of alloy.

It is a disadvantage of this process for manufacturing refractory metal alloys with a stacked microstructure that the process is limited to semi-finished products of relatively small dimensions, e.g. a maximum thickness of about 2 mm for sheet and a maximum diameter of about 1.7 mm for wire. A satisfactory stacked microstructure can as a rule not be achieved for semi-finished products exceeding these dimensions.

Special molybdenum alloys with a stacked microstructure are described in EU A1 119 436 in which the molybdenum is treated with approximately 0.005% to 0.75% by weight of at least one of the elements aluminum, silicon and potassium. This pre-publication also states that the high-temperature properties of the alloy can be further improved by treating this alloy with 0.2% to 3% by weight of at least one compound selected from the group of oxides, carbides, borides and nitrides of the elements La, Ce, Dy, I, In, Ti, Zr, Nb, Ta, Hf, V, Cr, Mo, W and Mg.

In manufacturing these special molybdenum alloys the sintered base material is reshaped with a reshaping factor of at least 85%, but preferably 95% and higher. As a particularly advantageous step, a first recrystallization annealing treatment is recommended after achieving a reshaping factor of between 45% and 85%. Subsequently, the material is reshaped further until the intended reshaping factor is reached, followed by a final recrystallization annealing step. No special directions are given concerning successive reshaping factors when reshaping the material further up to the desired reshaping factor. This special manufacturing process results in a certain improvement in the creeping strength and the high-temperature properties of these alloys compared to alloys that are manufactured without the intermediate subcritical annealing step. However, this manufacturing process also does not permit the production of semi-finished products from molybdenum alloys with a stacked microstructure whose sheet thickness or wire diameter are of greater dimension than those stated at the beginning.

It is the objective of the invention at hand to create a process for manufacturing semi-finished products of sintered refractory metal alloys with a stacked microstructure, suitable for producing semi-finished products of relatively large dimensions, or for achieving a substantially improved stacked microstructure as compared to the state of technology as described when producing semi-finished products having the same dimensions as heretofore.

In accordance with the invention, this is achieved by subjecting the sinter feed material, having been reshaped by at least 85%, to an intermediate annealing treatment during at least 20 minutes at a minimum temperature of 700° C. and a maximum temperature just short of recrystallization, and subsequently reshaping the material in a heated condition by an additional 3% to 30%.

The combination of the special intermediate annealing step for a base material that has been reshaped by at least 85%, with a subsequent reshaping step within a very specific range of reshaping, yields the completely surprising result that semi-finished products of sintered refractory metal alloys with a good stacked microstructure can be produced with substantially greater dimensions compared to semi-finished products manufactured by known processes, or which have a much improved stacked microstructure compared to the state of technology as described.

In this manner, the process according to the invention permits the production of sheet with thicknesses of up to about 10 mm and of rods having a diameter of up to about 50 mm, while at the same time forming a satisfactory stacked microstructure.

The intermediate annealing step and subsequent reshaping step can be repeated once or several times, with repetitions possible prior to as well as following the/a first recrystallization annealing step. The only absolute requirement is that the first intermediate annealing treatment and the subsequent reshaping step must occur prior to a first recrystallization annealing treatment. It is also important that intermediate annealing treatments and reshaping steps should only be carried out in combination with each other as long as the material has not been subjected to a first recrystallization annealing step.

Additional recrystallization annealing steps following a repeat cycle of intermediate annealing steps and reshaping steps can result in an additional improvement in the stacked microstructure compared to material that has been subjected to only one subcritical annealing step.

In case of a repeat cycle, the additional reshaping steps of from 3% to 30% relate to the respective cross-section of the material during the preceding annealing step.

The process according to the invention is particularly suited to refractory metal alloys of molybdenum, tungsten, chromium and to alloys of combinations of these metals, which have been treated with aluminum, potassium and silicon or with compounds and/or mixed phases from the group of oxides, nitrides, carbides, borides, silicates or aluminates having a melting point in excess of 1500° C.

The manufacturing process according to the invention will now be described in more detail by way of examples.

EXAMPLE 1

Potassium silicate solutions were sprayed into molybdenum oxide, which was then reduced to $MoO_2$ in a first step at approximately 650° C. in an $H_2$ counterflow, and further to molybdenum metal powder in a second step at approximately 1100° C. The amount sprayed in was apportioned so that the metal powder contained 0.175% by weight of silicon and 0.152% by weight of potassium.

The molybdenum powder with an average grain size of about 5 μm was then pressed into plates of size 550 mm×200 mm×70 mm on a die press at 3 MN.

Subsequently, the plates were sintered under an inert $H_2$ gas cover, using a heating time of 3 hours and a hold time of 5 hours at 1000° C.

The sintered plates were rolled, beginning at a reshaping temperature of about 1400° C., into sheets of 5.6 mm thickness in steps of approximately 10% reshaping at a time. After annealing at 1100° C. under an inert $H_2$ cover during 5 hours, the sheet was rolled down to the final 5 mm thickness.

Following a final recrystallization annealing step at 1900° C. during 15 minutes, the sheet assumed a stacked microstructure. The creep rate of this sheet amounted to $$6 \cdot 10^{-5} \frac{m/m}{h}$$

at 1800° C. and a load of 10N/mm$^2$.

It is also feasible to roll the 5 mm sheet down to 4.5 mm in one step after recrystallization annealing. In this case, the additional intermediate annealing step at 1100° C. and the additional final recrystallization annealing treatment can be omitted.

EXAMPLE 2

98.8% by weight of molybdenum powder with a mean grain size of about 5 μm was blended with 1.2% by weight of $La(OH)_3$ powder with a mean grain size of 0.4 μm in a mixing unit and was then pressed into plates of size 170 mm×400 mm×54 mm on a die press at 3 MN.

Subsequently, the plates were sintered under an inert $H_2$ gas cover, using a heating time of 3 hours and a hold time of 4 hours at 2000° C.

The sintered plates were rolled, beginning at a reshaping temperature of about 1400° C., into sheets of 2.2 mm thickness in steps of approximately 10% reshaping at a time. After annealing at 1100° C. under an inert $H_2$ cover during 5 hours, the sheet was rolled down to the final 2 mm thickness.

Following a final recrystallization annealing step at 2300° C. during 15 minutes, the sheet assumed a stacked microstructure, with the grains showing an average length/width ratio of 5:1. The creep rate of this sheet amounted to $$1.5 \cdot 10^{-4} \frac{m/m}{h}$$

at 1800° C. and a load of 10N/mm$^2$.

EXAMPLE 3

95.3% by weight of molybdenum powder with a mean grain size of about 5 μm was combined with 4.7% by weight of $La(OH)_3$ powder with a mean grain size of 0.4 μm and made into sheet of 2 mm thickness under the same conditions as in Example 2.

The final recrystallization annealing step took place at 2300° C. during 15 minutes. The resulting stacked microstructure showed grains with an average length/width ratio exceeding 10:1.

EXAMPLE 4

Blue tungsten oxide powder was blended with solutions of potassium silicate and aluminum chloride and reduced to a treated metal powder with a mean grain size of about 5 μm under an inert $H_2$ gas cover, containing 0.16% by weight of potassium, 0.19% by weight of silicon and 0.027% by weight of aluminum.

The powder was washed with hydrofluoric acid and pressed isostatically into square rods with a cross-section of 2 cm×2 cm at a pressure of 3 MN. Following a heating time of 5 hours, the rods were sintered under an inert $H_2$ cover at 2600° C. for 5 hours. Starting at reshaping temperatures of 1600° C., the sintered rods were forged into rods of 7 mm diameter in reshaping steps of about 10% each and were then drawn into wire with a diameter of 5.15 mm. After annealing under an inert $H_2$ cover at 1250° C. for 3 hours, the wire was drawn down further to a diameter of 5 mm in a single step.

The stacked microstructure was formed during a 15-minute recrystallization annealing treatment at 2300° C.

EXAMPLE 5

Molybdenum oxide powder was treated with a potassium silicate solution in such a manner that, after reduction, a mixture of molybdenum with 0.2% by weight of potassium and 0.315% by weight of silicon was obtained. This treated molybdenum powder was blended with an equal quantity of chromium powder and pressed into plates measuring 400 mm×170 mm×40 mm on a die press at a pressure of 3 MN.

The plates were then sintered under an inert $H_2$ gas cover, using a heating time of 3 hours and a hold time of 7 hours at 1700° C. The sintered plates were rolled, beginning at a reshaping temperature of about 1200° C., into sheets of 3.3 mm thickness in steps of approximately 10% reshaping at a time.

After annealing in a vacuum at 880° C. during 5 hours, the sheet was rolled down to the final 2 mm thickness at a temperature of 700° C.

The stacked microstructure was formed during a final 15-minute recrystallization annealing treatment at 1700° C.

EXAMPLE 6

This example compares the manufacture of semi-finished products of equal dimensions, on the one hand based on established technology and on the other hand according to the process covered by the invention.

It can be seen that the creep rate of the semi-finished product made by the process according to the invention is much lower and thus has a stacked microstructure, whereas the semi-finished product made by established technology does not have a stacked microstructure.

Molybdenum oxide powder was treated with a potassium silicate solution in such a manner that, after reduction, a mixture of molybdenum with 0.175% by weight of potassium and 0.152% by weight of silicon was obtained. This treated molybdenum powder with a mean grain size of about 5 μm was pressed into plates measuring 400 mm×170 mm×47 mm on a die press at a pressure of 3 MN.

The plates were then sintered under an inert $H_2$ gas cover, using a heating time of 3 hours and a hold time of 5 hours at 1700° C. A portion of these plates was rolled according to established technology, beginning at a reshaping temperature of about 1400° C., into sheets of 2 mm thickness in steps of approximately 10% reshaping at a time.

During a final recrystallization annealing treatment at 1900° C. during 15 minutes, no stacked microstructure was formed. The structure remained essentially fine-grained and had no longitudinal orientation. The creep rate of this sheet amounted to $$1.6 \cdot 10^{-2} \frac{m/m}{h}$$

at 1800° C. and a load of 10N/mm$^2$.

The remaining plates were rolled according to the process covered by the invention, beginning at a reshaping temperature of about 1400° C., into sheets of 2.2 mm thickness in the same steps of approximately 10% reshaping at a time.

After annealing under an inert $H_2$ gas cover at 1100° C. during 5 hours, the sheet was rolled down in one step to the final 2 mm thickness at a temperature of about 700° C.

After a final recrystallization annealing treatment at 1900° C. during 15 minutes, the sheet showed a good stacked microstructure. The creep rate of this sheet amounted to $$3.1 \cdot 10^{-4} \frac{m/m}{h}$$

at 1800° C. and a load of 10N/mm$^2$ (as against $$\left(\text{as against } 1.6 \cdot 10^{-2} \frac{m/m}{h}\right).$$

We claim:

1. Process for manufacturing semi-finished products from sintered refractory metal alloys with a stacked microstructure, in which the sintered metal alloy is reshaped mechanically by at least 85% in several reshaping steps and is then subjected to a recrystallization annealing treatment, wherein the sintered metal alloy, having been reshaped by at least 85%, is subjected to an intermediate annealing treatment prior to the recrystallization annealing treatment for at least 20 minutes at a minimum temperature of 700° C. and a maximum temperature which is below the recrystallization temperature, and is reshaped by another 3% to 30% in a heated state subsequent to the intermediate annealing step.

2. Process for manufacturing semi-finished products from sintered refractory metal alloys with a stacked microstructure according to claim 1, wherein said sintered refractory metal alloy comprises sintered molybdenum alloy and the intermediate annealing treatment is carried out for at least 20 minutes at a temperature of between 950° C. and 1300° C.

3. Process for manufacturing semi-finished products from sintered refractory metal alloys with a stacked microstructure according to claim 1, wherein said sintered refractory metal alloy comprises sintered tungsten alloy and the intermediate annealing treatment is carried out for at least 20 minutes at a temperature of between 1250° C. and 1700° C.

4. Process for manufacturing semi-finished products according to claim 1, wherein the reshaping after intermediate annealing amounts to 10% relative to the sintered refractory metal alloy that was already reshaped by at least 85%.

5. Process for manufacturing semi-finished products according to claim 2, wherein the reshaping after intermediate annealing amounts to 10% relative to the sintered refractory metal alloy that was already reshaped by at least 85%.

6. Process for manufacturing semi-finished products according to claim 3, wherein the reshaping after intermediate annealing amounts to 10% relative to the sintered refractory metal alloy that was already reshaped by at least 85%.

* * * * *

UNITED STATES PATENT AND TRADEMARK OFFICE

CERTIFICATE OF CORRECTION

PATENT NO. : 5,102,474

DATED : April 7, 1992

INVENTOR(S) : Ralf Eck, et al.

It is certified that error appears in the above-indentified patent and that said Letters Patent is hereby corrected as shown below:

On the title page, delete "[22] Filed: Sep. 1, 1990" and insert the following: --[22] Oct. 24, 1988
[86] PCT No.: PCT/AT88/0082
§ 371 Date: Sep. 1, 1989
§ 102 (e) Date: Sep. 1, 1989
[87] PCT Pub. No.: W089/04380
PCT Pub. Date: May 18, 1989--.

Signed and Sealed this

Twenty-second Day of February, 1994

*Attest:*

Bruce Lehman

BRUCE LEHMAN

*Attesting Officer*

*Commissioner of Patents and Trademarks*